US005184920A

United States Patent [19]

Strässle

[11] Patent Number: 5,184,920

[45] Date of Patent: Feb. 9, 1993

[54] CONNECTION ELEMENT FOR A ROD

[75] Inventor: Marcel Strässle, Kirchberg, Switzerland

[73] Assignee: Syma Intercontinental AG, Switzerland

[21] Appl. No.: 761,784

[22] PCT Filed: Feb. 13, 1991

[86] PCT No.: PCT/CH91/00039

§ 371 Date: Sep. 23, 1991

§ 102(e) Date: Sep. 23, 1991

[87] PCT Pub. No.: WO91/12383

PCT Pub. Date: Aug. 22, 1991

[30] Foreign Application Priority Data

Feb. 16, 1990 [CH] Switzerland ..... 506/90

[51] Int. Cl.[5] ..... F16D 1/00

[52] U.S. Cl. ..... 403/171; 403/176

[58] Field of Search ..... 403/171, 176

[56] References Cited

U.S. PATENT DOCUMENTS 3,982,841 9/1976 Endzweig ..... 403/348 X R
4,664,550 5/1987 Jachmann ..... 403/171
4,677,804 7/1987 Holt ..... 403/171 X R
4,789,264 12/1988 Inchaurbe ..... 403/171 X R
4,822,199 4/1989 Nehls ..... 403/171
4,848,952 7/1989 Strassle ..... 403/171
5,051,019 9/1991 Kohl ..... 403/171

*Primary Examiner*—Andrew V. Kundrat
*Attorney, Agent, or Firm*—Sughrue, Mion, Zinn, Macpeak & Seas

[57] ABSTRACT

A connection element for a three-dimensional framework includes a bolt (6, 7, 8, 9) which by means of a sleeve insert (3) can be fastened rotatably to one end of a rod (11), as well as a sleeve (12) into the axial through-bore of which the bolt is partly inserted, to transmit, sliding axially, a rotary movement of the sleeve (12) to the bolt. The through-bore is only in the front part of the sleeve (12) so that it can transmit a rotary movement of the sleeve (12) to the bolt. At the rear part of the sleeve (12) the through-bore has a circumference which is larger than the circumference of the form-locking front part of the through-bore. The bolt is urged out of the sleeve (12) by a spring (13). The front end part (9) of the connection element can be fastened to a junction part (10) of the three-dimensional framework.

14 Claims, 3 Drawing Sheets

CONNECTION ELEMENT FOR A ROD

BACKGROUND OF THE INVENTION

The present invention relates to a connection element for a rod of a three-dimensional framework.

Such a connection element is known from European Patent Application No. EP-A2-0 297 033.

SUMMARY OF THE INVENTION

It is the object of the invention to provide a different type of connection element, but of the same general kind as disclosed in the above-mentioned European Patent Application.

According to the invention, a connection element for a rod of a three-dimensional framework having a junction portion includes: a bolt having a front end portion which can be fastened to the junction portion of the three-dimensional framework; a sleeve insert, the bolt being rotatably fastened to an end of the rod by the sleeve insert; a sleeve having an axial through-bore into which the bolt is partially inserted so as to transmit a rotary movement of the sleeve to the bolt; and a spring for urging the bolt out of the sleeve. The through-bore of the sleeve at the front end portion of the sleeve has a form-locking shape so as to transmit the rotary movement of the sleeve to the bolt. The through-bore at the rear portion of the sleeve has a circumference which is larger than the circumference of the form-locking shape of the through-bore.

DETAILED DESCRIPTION OF THE PREFERRED EMBODIMENTS

Figure 1:
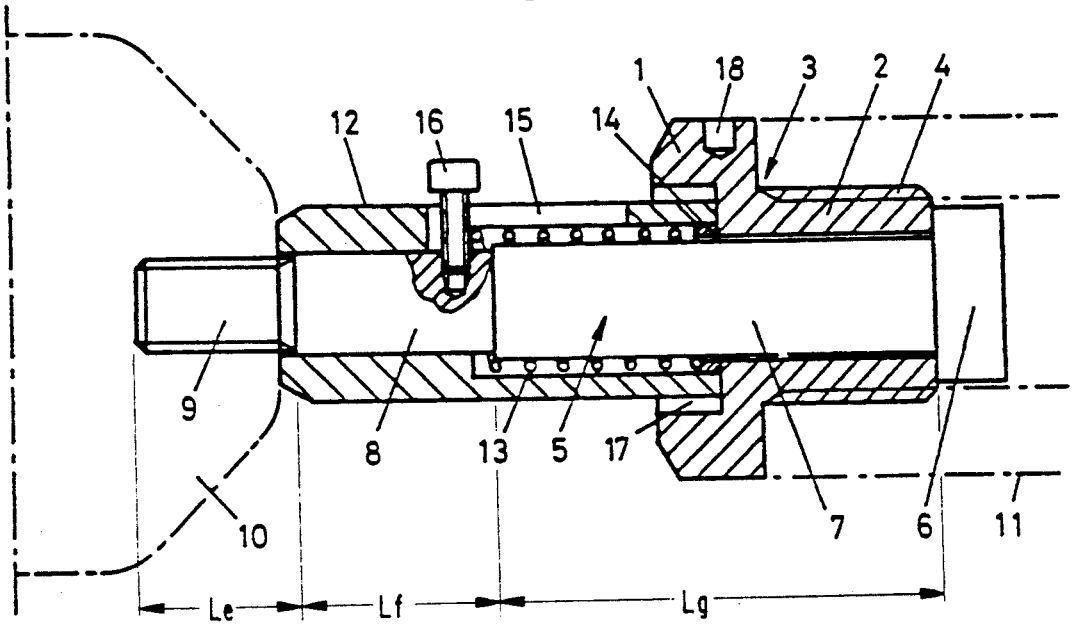
FIG. 1 to 5 show diagrammatic sectional views of various embodiments of a connection element according to the invention.

The connection element according to FIG. 1 comprises a sleeve insert 3 consisting of a flange-shaped sleeve head 1 and a tubular part 2, wherein the tubular part 2 is provided with an external thread 4 for fastening it to one end of a rod of a three-dimensional framework. A bolt 5 is guided through a through-bore of the sleeve insert 3, the head 6 of the bolt 5 resting on the end wall of the tubular part 2.

The bolt 5 has a longish, smooth, round part 7 of the length Lg, a guide part 8 of the length Lf, the cross-section of which may be polygonal, and an end part 9 of the length Le, which is provided with an external thread for fastening the connection element to a junction part of the three-dimensional framework. To simplify the drawing, the junction part 10 and the rod are indicated only by broken lines. In particular, the length Lg may be greater than the total of the lengths Lf and Le.

The bolt 5 is guided through the through-bore of a guide sleeve 12, from which the end part 9 projects. At the front part of the guide sleeve 12 this through-bore is made form-locking with the guide part 8 of the threaded bolt 5, so that a rotary movement of the guide sleeve 12 can be transmitted to the bolt 5 with as little play as possible.

The through-bore of the front part of the guide sleeve 12 can, therefore, be the same as the guide part 8 of the bolt 5, (i.e., the cross-section also is polygonal). However, preferably the cross-sections of guide part 8 and the through-bore of the front part of the guide sleeve are hexagonal. In contrast thereto the through-bore has in the rear part of the guide sleeve 12 a preferably round cross-section, in which case there occurs between the round part 7 of the bolt 5 and the preferably cylindrical inside wall of the guide sleeve 12 a relatively large gap, to form an open space in which a coil spring 13 can be accommodated. At the end of the rear part of the guide sleeve 12, preferably in the gap, an annular disk 14 is arranged and connected to it.

In the shell of the guide sleeve 12 an elongated opening 15 is provided, through which a pin can be loosely inserted and connected to the bolt 5, preferably radially in its guide part 8.

The coil spring 13 is arranged in the gap in such a way that on the right (as view from FIG. 1) it rests on the annular disk 14 and on the left, it rests on the pin 16 to press or urge it forward so as to urge the end part 9 of the bolt out of the guide sleeve 12, which it is, for example, pushed by hand into the guide sleeve 12. The transmission of the rotary movement is ensured by the form-locking between the front part of the guide sleeve 12 and the bolt 5. On the other hand, the pin 16 is provided so that the bolt 5 can be pushed with the fingers along the elongated opening 15 against the urging action of the spring 13.

The embodiment according to FIG. 1 has the property that the spring 13 remains clamped in the sleeve 12 when this is closed off by the disk 14, e.g., by cementing or welding. Therefore, it is no longer easy to remove the spring 13 from the sleeve 12. This property is sometimes desirable so that the spring 13 will not get lost. Besides this advantage, however, the connection element according to FIG. 1 has the disadvantage that the bolt 5 is relatively long. In many cases, considerable disadvantage can be avoided by employing a round recess 17 on the face of the sleeve head 1. The circumference of this recess 17 must be slightly larger than the circumference of the guide sleeve 12, which on the outside may, for example, have a polygonal cross-section. On the periphery of the sleeve head 1 a recess 18 is provided so that with the aid of a tool, the sleeve insert 3 can be screwed onto the end of the rod 11.

Figure 2:
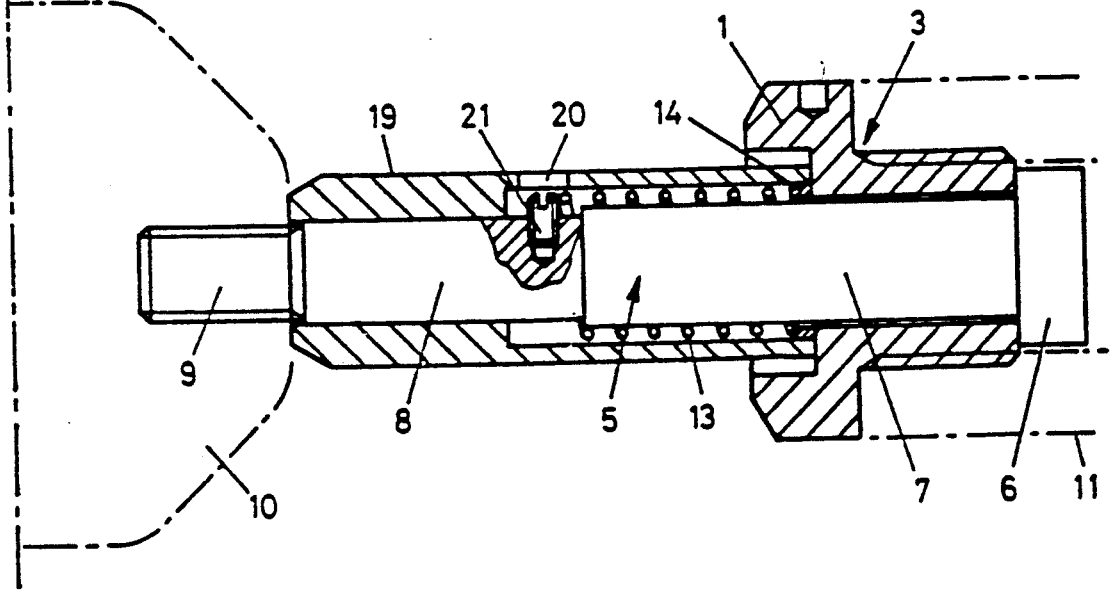

The connection element according to FIG. 2 corresponds essentially to that of FIG. 1, wherein for identical parts the same reference numerals were used. The sleeve 19 according to FIG. 2 has only a small round opening 20, so that after assembling the guide sleeve 19 a countersunk pin 21 can be fastened on the bolt 5. Such a design is often preferred when, for aesthetic reasons, the visible pin is to be dispensed with. Naturally, in such a case the play between the head of the pin 21 and the round inside wall of the guide sleeve 19 is quite large. As the diameter of the coil spring 13 is well defined and smaller than the projecting part of the pin 21, no slipping of the spring 13 over the head of the pin 21 can take place. The diameter of the opening 20 must be slightly larger than the diameter of the pin 21 so that the latter can be pulled out. If need be, the opening 20 can be dispensed with, e.g., when the ring 14 is fastened in the sleeve 19 after assembling the spring 13 and the bolt 5.

Figure 3:
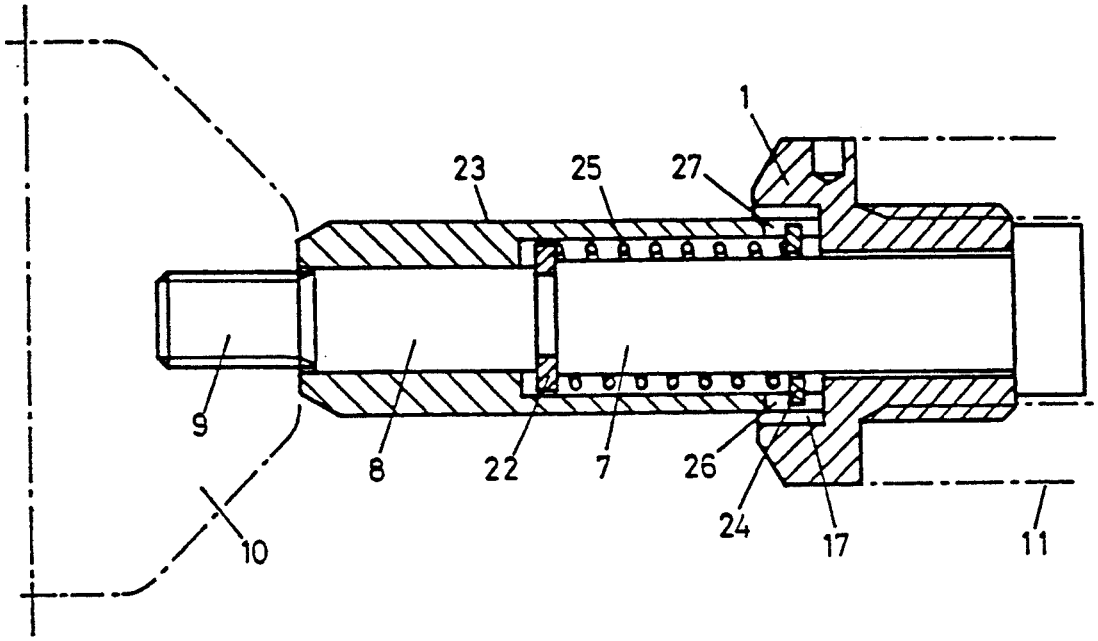

The connection element according to FIG. 3 corresponds essentially to that of FIG. 1, and also here the same reference numerals were used for identical parts. With this design the bolt has a radial groove, which is positioned in the plane perpendicular to the longitudinal axis of the bolt at least approximately in the area between the smooth part 7 and the guide part 8. An open annular spring 22 is placed in this groove, the outside diameter of spring 22 is slightly smaller than the inside diameter of the rear part of the guide sleeve 23, but larger than the diameter of the smooth part 7. The thickness of the annular spring 22 may, for example, be smaller than the diameter of the pins 16 or 21 according to FIG. 1 and 2, respectively. In this case, the guide sleeve 23 does not have an opening. With the embodiment shown in FIG. 3 it is necessary, however, to provide a detachable annular disk which may, for example, be an annular spring that can be clamped into a groove at the end of the sleeve 23.

At its rear end the sleeve 23 has two diametrically opposed openings 26, 27, i.e, in the area where the groove is positioned into which the annular spring 24 can be clamped, so that the latter can be pulled out with the aid of tongues. The openings 26, 27 may be slightly shorter than the height of the recess 17 of the sleeve head 1, so that in an assembled state they remain hidden. As shown in FIG. 3, the spring 25 is pressed between the annular springs 22 and 24. The open annular spring 24 could also be used in the connection element according to FIG. 1.

Figure 4:
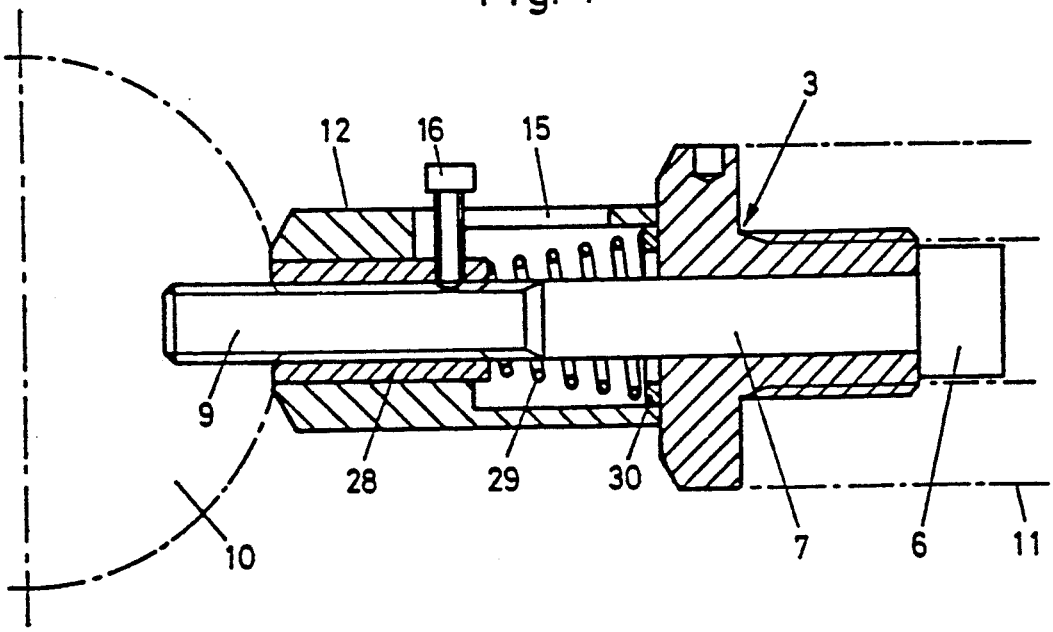

The connection element according to FIG. 4 corresponds to another variant of the type shown in FIG. 1, wherein for identical parts the same reference numerals were used. In FIG. 4, the bolt comprises, besides the head 6, only two parts 7 and 9, and the sleeve insert 3 may be with or without a recess 17 (FIG. 1). Between the part 9 and the guide sleeve 12 a guide insert 28 is inserted, which has an internal thread, and on the outside form-locks with the front part of the through-bore of the guide sleeve 12.

The through-bore of the front part of the guide sleeve 12 may therefore, be the same as the guide part of the guide insert 28, i.e., also polygonal. Preferably, however, these cross-sections are hexagonal. In contrast thereto, in the rear part of the guide sleeve 12 the through-bore has a larger, preferably round crosssection, in which case there occurs between the round part 7 of the bolt and the preferably cylindrical inside wall of the guide sleeve 12 a relatively large gap. This gap is larger than the gap shown in the embodiment of FIG. 1, and forms a space in which a conical spring 29 can be accommodated. The diameter of conical spring 29 at its front is smaller than its rear, so that at the front spring 29 presses against the guide insert 28, and at the rear spring 29 presses against an annular disk 30 arranged on the end of the guide sleeve 12. The through-bore of the guide sleeve 12 has the same cross-sectional shape and/or is slightly larger than the guide insert 28, so that the guide insert 28 can be disposed through this through-bore. In this case it is easier, after removing the bolt, to take out the spring 29 by pulling and turning.

Figure 5:
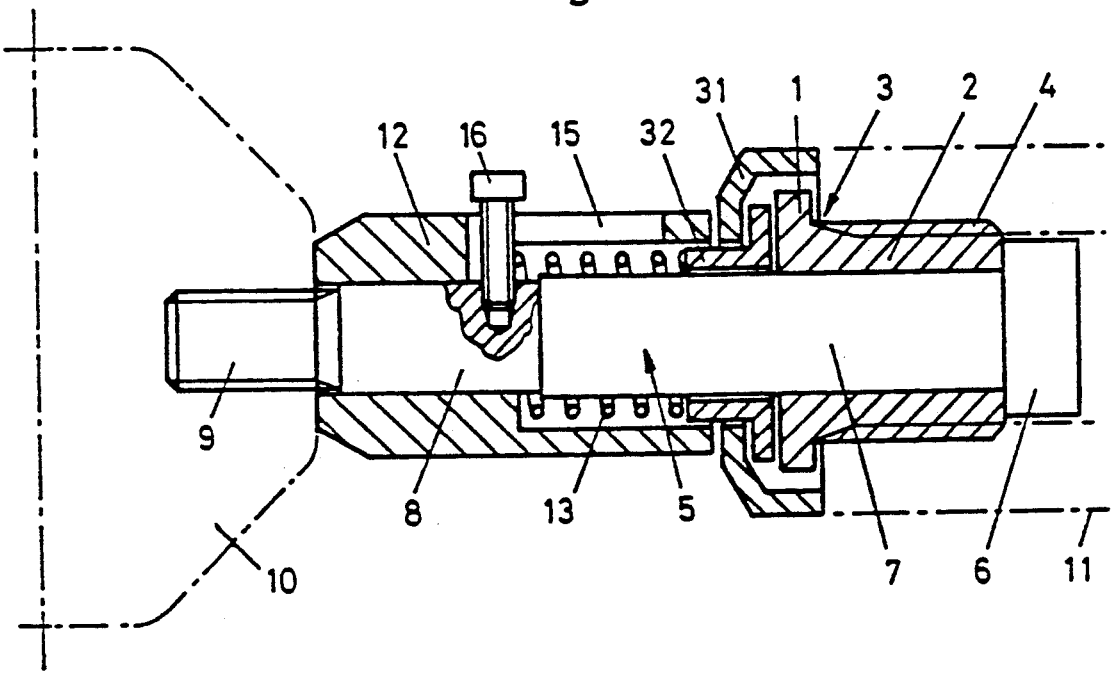

The connection element according to FIG. 5 corresponds essentially to the type of FIG. 1, wherein for identical parts the same reference numerals were used. However, as shown in FIG. 5, at the rear end of the guide sleeve 12 an at least approximately bell-shaped flange ring 31 is provided. The ring 31 delimits an inside space which is dimensional such that the head 1 of the sleeve insert 3 can be accommodated therein.

With the embodiment according to FIG. 5, the bell-shaped figure ring 31 is separate from the actual guide sleeve 12, and a bush 32 is provided to fasten the flange ring 31 to the guide sleeve 12, e.g., by screwing or by a bayonet connection. The flange ring 31, the bush 32 and the guide sleeve 12 form a guiding device for the connection element.

The connection element according to FIG. 5 has the property that the spring no longer remains constantly clamped-in the sleeve 12, if sleeve 12 is closed off by the bush 32, e.g., by screwing on. The spring 13 can, therefore, be easily removed from the sleeve 12. This property is often desirable so that the spring 13 can be replaced more easily. In addition to this advantage, the connection element of FIG. 5 has the further advantage that due to the bell-shaped flange ring 31, a well matching transition can be realized between the rod 11 and the guide sleeve 12. As shown in FIG. 5, the shell of the guide sleeve 12 has no opening, and therefore sleeve 12 can be dismantled very easily. Instead of the pin 16, a projection of the bolt in the parts 7 and/or 8 may be provided, in which case the opening 15 may also be provided up to the rear end of the guide sleeve 12.

In a further embodiment of the invention, the flange ring 31 may form an integral part with the rear end of the guide sleeve 12.

According to a further embodiment of the invention, the flange ring 31 could form an integral part with the bush 28.

In a further embodiment of the invention, the bush 32 can be removed and, instead, the flange ring 31 may have a wall with a through-bore, the diameter of which is slightly larger than the maximum diameter of the bolt 5.

Further, the outside of the flange ring 31 may be conical to adapt the larger circumference of the rod 11 to the smaller circumference of the guide sleeve 12.

With the exception of the springs, the connection element may be made from aluminum or another light metal alloy.

The flange ring 31 may be made from plastic, and if ring 31 forms an integral part of the sleeve 12 (FIG. 5), then sleeve 12 may also be made from plastic.

The variants of a sleeve with a flange ring explained in connection with FIG. 5 can be used for the other embodiments of the connection elements.

In addition, instead of a coil spring it is also possible to use a spring that is put on from the side, e.g., a meander-shaped spring, and that with a view to maintaining the tolerances, the flange ring and/or the sleeve may be made from die cast metal, e.g., bronze or zinc die castings.

I claim:

1. A connection element for a rod (11) of a threedimensional framework having a junction portion (10), the connection element comprising:

a bolt (5) having a guide portion (8), a long portion (7), and a front end portion (9), the front end portion being adapted to be fastened to the junction portion (10) of the three-dimensional framework;

a sleeve insert (3), said bolt being rotatably fastened to an end of the rod by said sleeve insert;

a guide sleeve (12) having an axial through-bore, said bolt being partially inserted in the through-bore such that the front end portion of said bolt projects from the through-bore; and a spring (13) positioned in the through-bore so as to urge said front end portion of said bolt out of said guide sleeve;

wherein a first portion of the through-bore has a circumference which is substantially equal to a circumference of the guide portion (8) of said bolt so that the guide portion of said bolt can be inserted therein and so that a rotary movement of said guide sleeve can be transmitted to said bolt, and wherein a second portion of the through-bore has a circumference which is larger than a circumference of the long portion (7) of said bolt so that a gap is formed therebetween.

2. The connection element according to claim 1, wherein the second portion of the through-bore has a round cross-section.

3. The connection element according to claim 1, wherein said bolt (5) is unitary, a cross section of the long portion (7) of said bolt is round, the guide portion 98) of said bolt is disposed between the long portion (8) of said bolt and the front end portion of said bolt, and wherein a circumference of the guide portion of said bolt is at least as large as a circumference of the front end portion of said bolt.

4. The connection element according to claim 1, further comprising a guide insert (28) disposed so as to ensure that the circumference of the first portion of the through-bore is substantially equal to the circumference of the guide portion of said bolt.

5. The connection element according to claim 1, wherein said bolt further includes a projection (16) disposed perpendicular to an axis of rotation of said bolt.

6. The connection element according to claim 4, wherein said guide insert includes a projection (16, 22), said projection being disposed perpendicular to an axis of rotation of said bolt.

7. The connection element according to claim 5, wherein the guide portion of said bolt includes said projection.

8. The connection element according to claim 6, wherein said guide insert and said bolt includes said projection.

9. The connection element according to claim 1, further comprising an annular disk (14, 24) disposed adjacent to the long portion of said bolt, and wherein an inside diameter of said annular disk is larger than an outside diameter of the long portion of said bolt.

10. The connection element according to claim 5, wherein said projection comprises a pin (16), and wherein said guide sleeve (19) has an opening (20) so that said pin can be pulled-out through the sleeve opening.

11. The connection element according to claim 1, wherein the second portion of the through-bore has an elongated opening (15) which extends in an axis which is substantially parallel to a longitudinal axis of said bolt.

12. The connection element according to claim 1, wherein said sleeve insert (3) comprises a flange-shaped sleeve head (1) having a recessed-face (17) into which a rear portion of said guide sleeve (12, 23) can be partially inserted.

13. The connection element according to claim 12, further comprising an approximately bell-shaped flange ring (31) disposed between the rod (11) and said guide sleeve (12), said bell-shape flange ring defining a space therein which is dimensioned such that at least a portion of said sleeve insert (3) can be accommodated in the space.

14. The connection element according to claim 1, wherein a cross-section of the first portion of the through-bore, and a cross-section of the guide portion of said bolt each has a polygonal shape.

* * * * *